US008210995B2

(12) United States Patent
Reyes

(10) Patent No.: US 8,210,995 B2
(45) Date of Patent: Jul. 3, 2012

(54) SHOULDER FLEXION APPARATUS AND METHOD

(75) Inventor: Gil Reyes, Las Vegas, NV (US)

(73) Assignee: Graa Innovations, LLC, Las Vegas, NV (US)

( * ) Notice: Subject to any disclaimer, the term of this patent is extended or adjusted under 35 U.S.C. 154(b) by 0 days.

(21) Appl. No.: 12/731,289

(22) Filed: Mar. 25, 2010

(65) Prior Publication Data

US 2011/0237405 A1 Sep. 29, 2011

(51) Int. Cl.
*A63B 221/00* (2006.01)

(52) U.S. Cl. ..... 482/98; 482/102

(58) Field of Classification Search ..... 482/94, 482/98, 99, 100, 103, 101, 102
See application file for complete search history.

(56) References Cited

U.S. PATENT DOCUMENTS

| | | | | |
|---|---|---|---|---|
| 339,638 | A | 4/1886 | Goldie | |
| 3,019,019 | A | 1/1962 | Forte | |
| 3,373,993 | A | 3/1968 | Oja et al. | |
| 3,465,750 | A | 9/1969 | Schawalder | |
| 3,524,644 | A | 8/1970 | Kane | |
| 3,635,472 | A | 1/1972 | Marcyan | |
| 3,905,599 | A | 9/1975 | Mazman | |
| 4,239,210 | A | 12/1980 | Lambert, Jr. | |
| 4,706,953 | A | 11/1987 | Graham | |
| 4,721,301 | A | 1/1988 | Drake | |
| 4,898,381 | A * | 2/1990 | Gordon | 482/103 |
| 5,066,005 | A | 11/1991 | Luecke | |
| 5,681,249 | A | 10/1997 | Endelman | |
| 5,733,229 | A | 3/1998 | Dalebout et al. | |
| 5,800,321 | A | 9/1998 | Webber | |
| 5,964,684 | A | 10/1999 | Sokol | |
| 5,967,950 | A | 10/1999 | Hsu | |
| 6,120,425 | A | 9/2000 | Endelman | |
| 6,336,894 | B1 | 1/2002 | Kestila | |
| 6,338,704 | B1 | 1/2002 | Endelman | |
| 6,482,134 | B1 | 11/2002 | Rasmussen | |
| 6,561,956 | B1 | 5/2003 | Allison | |
| 6,632,160 | B2 | 10/2003 | LaFond et al. | |
| 6,786,847 | B1 | 9/2004 | Morgan et al. | |
| 7,288,053 | B2 | 10/2007 | Endelman et al. | |
| 7,335,141 | B2 | 2/2008 | Piane, Jr. | |
| 7,563,207 | B1 | 7/2009 | Burek | |
| 7,632,221 | B1 * | 12/2009 | Kolander | 482/94 |
| 7,722,509 | B2 * | 5/2010 | Eder | 482/99 |
| 7,874,965 | B2 * | 1/2011 | Alessandri et al. | 482/103 |

* cited by examiner

*Primary Examiner* — Jerome w Donnelly
(74) *Attorney, Agent, or Firm* — Jones Day

(57) ABSTRACT

A shoulder flexion apparatus tones and strengthens the shoulder muscles, including the anterior deltoid muscles. The apparatus may provide a resistance having a downward force vector. The resistance may be applied to a user via a cable guided by one or more pulleys to the user. In one or more embodiments, a guide assembly may be provided to quickly and easily reposition the cable and the force vector of the resistance that the cable provides. The guide assembly thus allows rapid switching between shoulder exercises to tone and strengthen the shoulder muscles. The apparatus may comprise one or more sections corresponding to the left and right side of the user's body. In this manner, the sections may independently provide resistance to each of the user's shoulders.

1 Claim, 9 Drawing Sheets

SHOULDER FLEXION APPARATUS AND METHOD

BACKGROUND OF THE INVENTION

1. Field of the Invention

The invention relates to exercise equipment and in particular to a shoulder flexion apparatus and method of training therefor.

2. Related Art

Development the frontal deltoid muscles is often a misunderstood. The frontal deltoid muscles are located at a user's shoulders. In the past, should excersizes were performed using free weights with lifts such as military press and standing arm extensions, or on machines. Prior art shoulder excercises are known in the art and hence not discussed again in detail herein. In the prior art, it was understood that these prior art shoulder exercises may be used to effectively strengthen and tone these muscles.

From the discussion that follows, it will become apparent that the present invention addresses the deficiencies associated with the prior art while providing numerous additional advantages and benefits not contemplated or possible with prior art constructions.

SUMMARY OF THE INVENTION

Although in the prior art, it was believed that these prior art shoulder exercises may be used to effectively strengthen and tone these muscles, the inventor asserts that the exercise method and apparatus disclosed below is more effective. Further, this is true despite the fact that the deltoid muscles are considered to be part of a user's shoulders.

A shoulder flexion apparatus is disclosed herein. The shoulder flexion apparatus may be used to tone and strengthen the shoulder muscles and associated body structures. In one or more embodiments, the shoulder flexion apparatus targets the anterior deltoid region or muscles of the shoulders. The shoulder flexion apparatus provides the benefit of rapid switching between a plurality of exercises. In this manner, a user's shoulders may be comprehensively trained, as will be described further below.

The shoulder flexion apparatus may be configured in a variety of ways. In one embodiment for example, the shoulder flexion apparatus may comprise a first frame and a second frame, and a plurality of resistance devices configured to provide resistance to a user along at least one force vector. A plurality of guide assemblies supported by the first frame and second frame may be included. The guide assemblies may be configured to guide the resistance to the user from a first position and a second position. The plurality of guide assemblies are movable from the first position to the second position. There may be at least one joint between the first frame and the second frame. This joint may be configured to allow the first frame and second frame to move relative to one another. Moving the first frame and second frame may reposition the plurality of guide assemblies.

It is noted that the first frame may be configured as a left section of the shoulder flexion apparatus and the second frame may be configured as a right section of the shoulder flexion apparatus. The first frame may support one of the plurality of guide assemblies and the second frame may support another of the plurality of guide assemblies. It is noted that the plurality of guide assemblies may be rotatably mounted to the first frame and the second frame.

A plurality of cables attached at a first end to the plurality of resistance devices and at a second end to a handle may also be provided. Accordingly, the plurality of guide assemblies may be configured to guide the plurality of cables to the user from one or more positions. For example, the plurality of guide assemblies may comprise one or more pulleys.

In another embodiment, the shoulder flexion apparatus may comprise a first and second guide assembly. The first guide assembly may be configured to present a first resistance to a user along at least one first force vector, and the first guide assembly may be movable to change the at least one first force vector. The second guide assembly may be configured to present a second resistance to a user along at least one second force vector, and the second guide assembly may be movable to change the at least one second force vector. A plurality of resistance devices configured to provide the first resistance and the second resistance may also be included.

One or more supports may also be provided. For example, a first support comprising a lower portion and an upper portion, with the first guide assembly attached to the lower portion of the first support, may be provided. In addition, a second support comprising a lower portion and an upper portion, with the second guide assembly attached to the lower portion of the second support, may be provided. One or more pivots may be between the first support and the second support, such that the first support and second support may be movable via the one or more pivots.

The shoulder flexion apparatus may also have a first cable and a second cable. The first cable may be configured to transfer the resistance from one of the plurality of resistance devices to a left side of the user, while the second cable may be configured to transfer the resistance from another of the plurality of resistance devices to a right side of the user.

In addition, it is noted that the first guide assembly and the second guide assembly may comprise one or more pulleys. The one or more pulleys may be configured to guide a plurality of cables to the user, where the plurality of cables transfer resistance from the plurality of resistance devices to the user. It is contemplated that the first guide assembly may be rotatably attached to the first support.

A method of shoulder exercise by a user at a shoulder exercise apparatus is also disclosed herein. In one embodiment, the method may comprise engaging a first resistance by grasping a first handle with a left hand, engaging a second resistance by grasping a second handle with a right hand, and positioning the left hand in front of the user and the right hand in front of the user. The left hand may be moved vertically to move the first resistance, and the right hand may be moved vertically to move the second resistance.

The method may also include positioning the left hand at a left side of the user and the right hand at a second right of the user. Positioning the left hand and the right hand in front of the user may move a first and second guide assembly to a first position while positioning the left hand and the right hand at the left and right sides of the user may move the first and second guide assembly to a second position distinct from the first position. It is noted that the left hand may be moved vertically to move the first resistance while the first and second guide assembly are in the second position.

Moving the left hand and moving the right hand may occur in various ways. For example, such movement may comprise raising and lowering the left hand and the right hand by moving a left arm and a right arm. As another example, moving the left hand and moving the right hand may comprise raising and lowering the left hand and the right hand by bending a left and right arm at a left elbow and a right elbow. It is contemplated that moving the left hand and positioning the left hand at the left side of the user may occur simultaneously. Likewise, moving the right hand and positioning the right hand at the right side of the user may occur simultaneously.

It is contemplated that the method may also include moving a section of the shoulder exercise apparatus horizontally to change the distance between the first guide assembly and the second guide assembly.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the shoulder flexion apparatus is directed to toning and strengthening the deltoid muscles. In one or more embodiments, the shoulder flexion apparatus targets the frontal deltoid muscles, as will be described further below. In addition, corresponding body structures such as tendons, bones, and the like may also be toned and strengthened. It will be understood that other muscles and body structures associated with movement or use of the deltoid muscles may be toned and strengthened as well.

In one or more embodiments, the shoulder flexion apparatus utilizes one or more particular movements of the arms to train the frontal deltoid muscles. This is highly beneficial in that these movements target the frontal deltoid muscles and thus efficiently train these muscles. The frontal deltoid muscles are traditionally difficult to train because traditional exercises and devices utilize shoulder movements which to not effectively target the frontal deltoid regions.

Figure 1A:
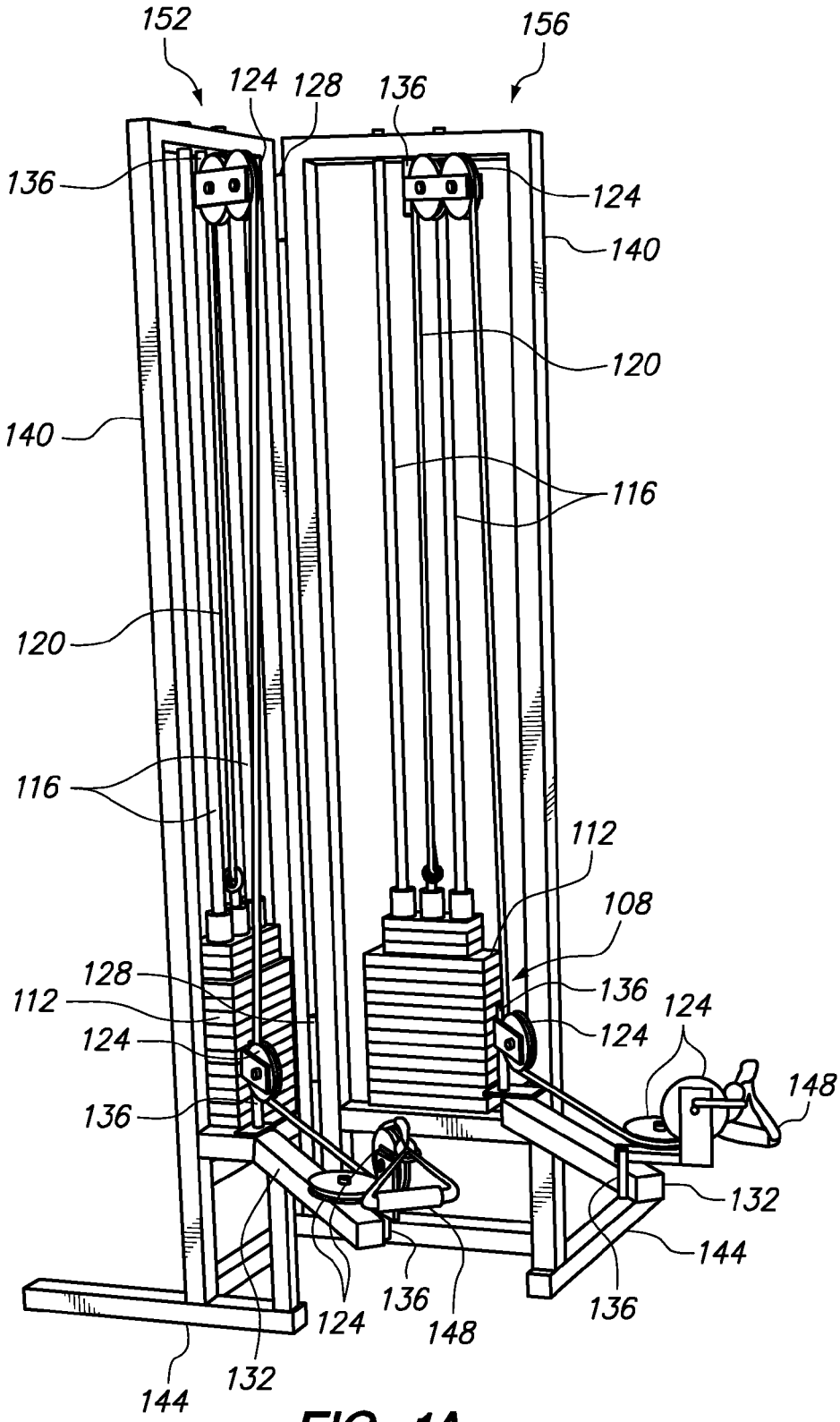
FIG. 1A is a front perspective view of an exemplary shoulder flexion apparatus.

The shoulder flexion apparatus will now be described with regard to FIG. 1A. FIG. 1A provides a front perspective view of the shoulder flexion apparatus. As can be seen, the shoulder flexion apparatus may have a first lateral section 152 and a second lateral section 156. For instance, in FIG. 1A, the shoulder flexion apparatus comprises a left side or section and a right side or section. In general, these sections correspond to the sides of a user's body. The sections may be configured to provide resistance to either or both sides of a user's body to tone and strengthen the shoulder muscles and structures, namely the frontal deltoid area. As shown for example, the sections 152,156 each comprise a resistance device 108 held by a support assembly 104 which may be used to provide resistance to the left and/or right side of a user's body.

Typically, each section 152,156 will be similarly or identically configured. In FIG. 1A for example, the sections 152, 156 each comprise a frame 140, a resistance device 108, an extension arm 132, pulleys 124, and base members 144, among other things. The sections 152,156 may be thought of as mirror images of one another. In this manner, both sides of a user's body can experience the same training It is contemplated however, that each section 152,156 may be configured differently. For example, a first section 152 may comprise a resistance device 108 of a first type, while a second section 156 comprises a resistance device of a second type. This may be beneficial when a user is weaker (or stronger) on one side, such as in the case of rehabilitation.

Portions of the following describe various embodiments of a shoulder flexion apparatus with reference to one section of the apparatus. It will be understood that various sections of the shoulder flexion apparatus may be configured in the variety of configurations set out herein. In addition, the sections of the shoulder flexion apparatus (e.g., left and right sections) may have similar, the same, or different configurations, as stated above.

A section 152 of the shoulder flexion apparatus may comprise one or more support structures which may be configured to support or hold one or more components of the apparatus. For example, in FIG. 1A, the shoulder flexion apparatus comprises a frame 140. The frame 140 may comprise one or more elements, such as one or more members, for supporting one or more resistance devices 108 or other components of the shoulder flexion apparatus. To illustrate, as shown, the frame 140 comprises a rectangular structure having a cross member to support a resistance device 108. The frame 140 also supports and extension arm 132 which will be described further below.

It is contemplated that the frame 140 may be configured in various shapes and sizes. For example, the frame 140 may include one or more curves, angles, various shapes, and the like. In addition, the frame 140 need not be "open" in all embodiments. For example, the frame 140 may have one or more panels or the like to enclose various components of the shoulder flexion apparatus.

One or more sections 152,156 of the shoulder flexion apparatus may include a base portion in one or more embodiments. In general, the base portion may be used to ensure that the frame 140 (and thus the shoulder flexion apparatus) remains stable relative to the floor or other surface upon which it is placed. It is contemplated that the frame 140 may be attached or secured to another structure in some embodiments. For example, a portion of the frame 140, such as one of its members, may be attached to a wall, the floor, or another structure to provide stability to the shoulder flexion apparatus. In one or more embodiments, the base portion may include one or more structures such as one or more base members 144 which provide stability to the frame 140. However, base members 144 may not be included in all embodiments, as the shoulder flexion apparatus may be stable without the base members.

As will be described further below, the sections 152, 156 of the shoulder flexion apparatus may be movable relative to one another. For this reason, the base portion of a section 152 may be configured to move or other aspects of the sections 152, 156 may be made to move relative to the base 144. For example, in some embodiments, the base portion may have one or more wheels, such as casters for example, to allow the section 152 to be easily moved. In other embodiments, the base portion 144 may ride on a track or other guide to allow its section 152 to move. It is contemplated that once the desired position of a section 152 is achieved, the section may be secured in place. For example, an embodiment may comprise locking casters or wheels which secure a section 152 in place once in the desired position. In one optional embodiment, the sections 152, 156 may move during operation to match the movement of the shoulders or arms.

As stated, the shoulder flexion apparatus provides a resistance to a user to train the shoulder muscles, namely the front deltoid muscles, although other groups of muscles also benefit. The resistance provided may have a particular force vector as it is presented to the user. For example, in one or more embodiments, the user experiences a downward force vector when training on the shoulder flexion apparatus.

Each section 152 may include an extension arm 132. In general, the extension arm 132 is configured to present the resistance to the user at a variety of force vectors. Typically, the force vector will be directed downward from the user's shoulders or arms. As will be described further below, this force vector is highly beneficial to training the frontal deltoid muscles and associated body structures.

Figure 1B:
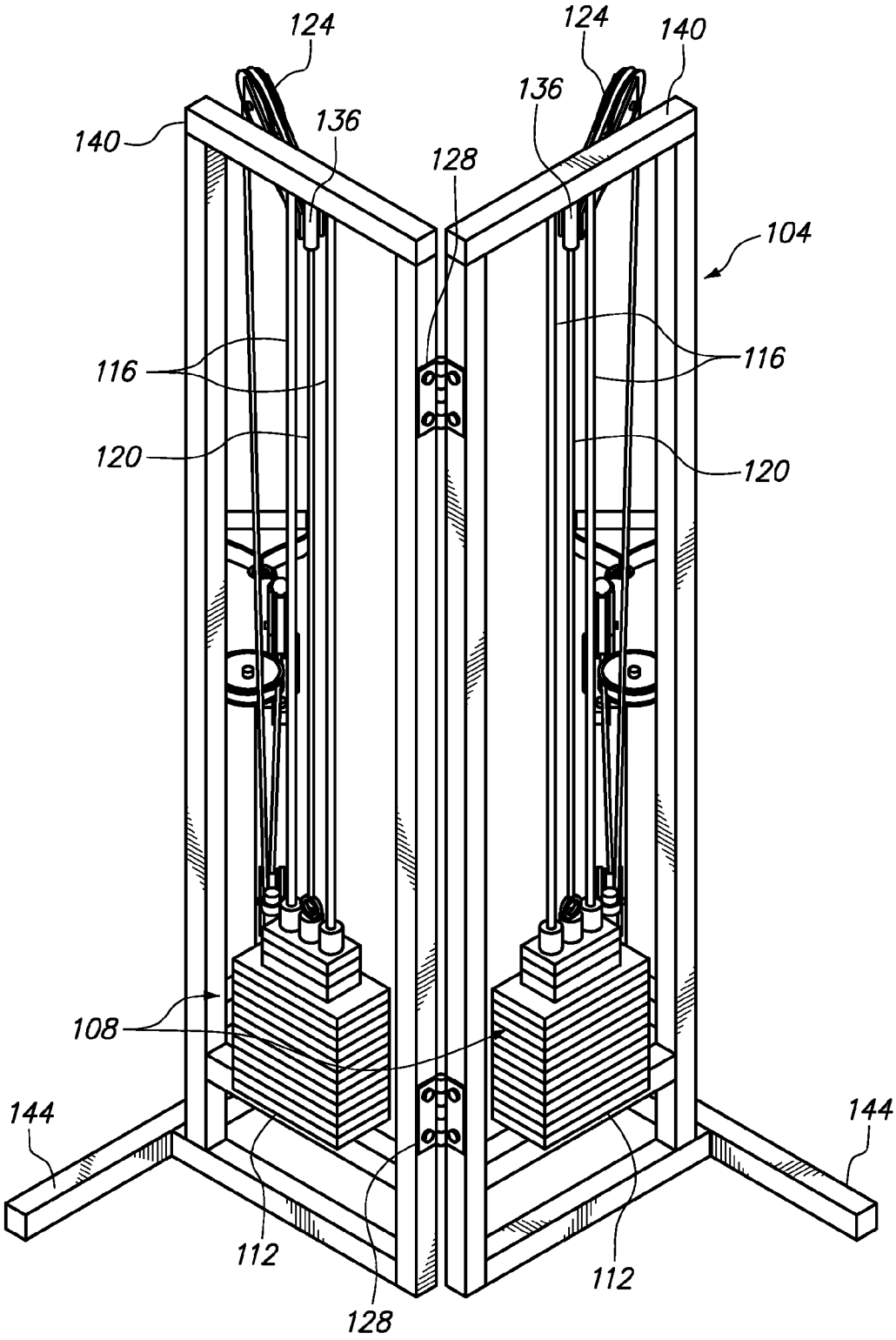
FIG. 1B is a back perspective view of an exemplary shoulder flexion apparatus.
Figure 1C:
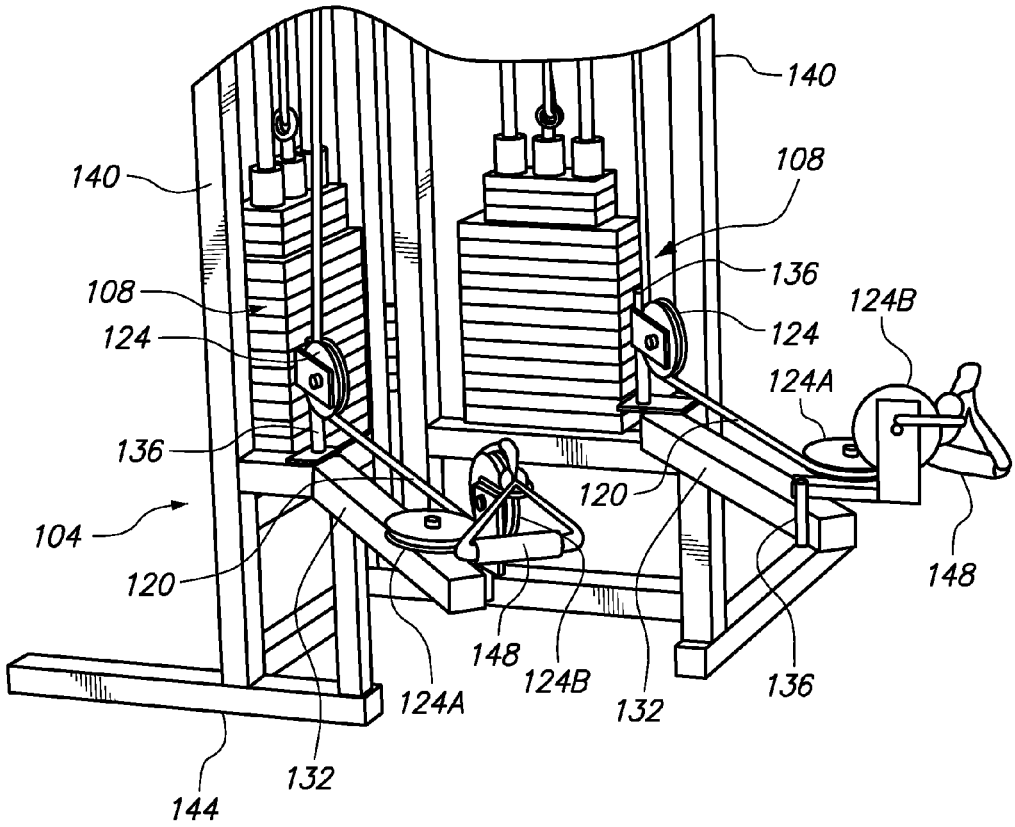
FIG. 1C is a side perspective view of a lower section of an exemplary shoulder flexion apparatus.
Figure 1D:
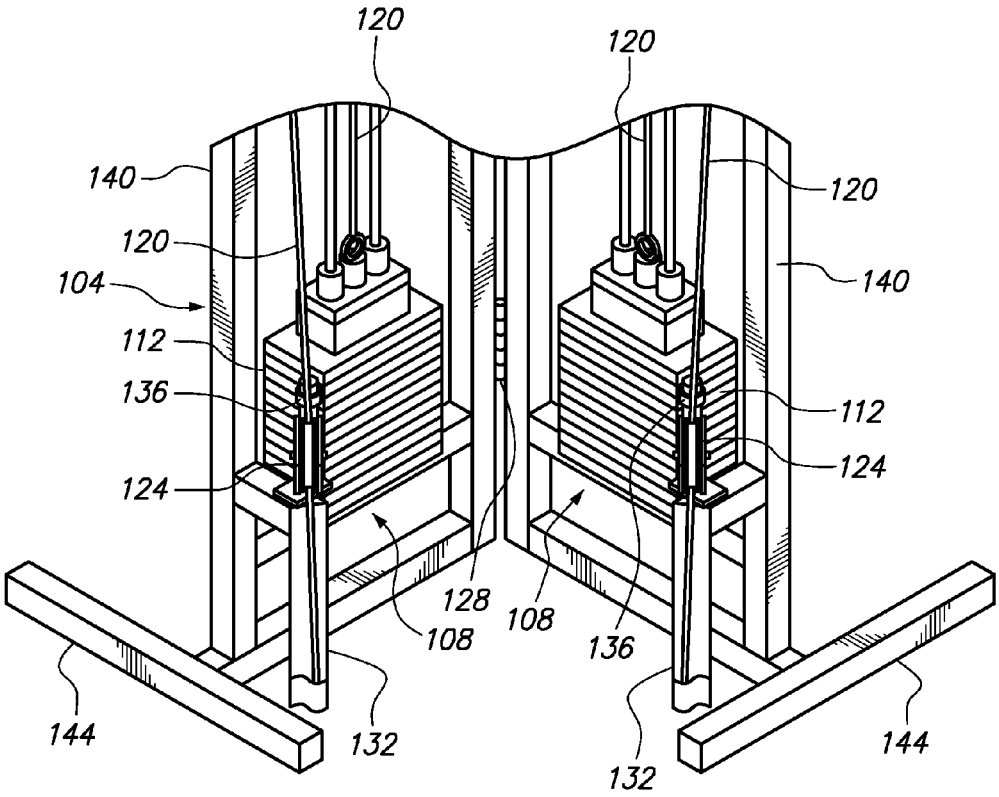
FIG. 1D is a front perspective view of a lower section of an exemplary shoulder flexion apparatus.

In one or more embodiments, the resistance may be presented to the user from a portion of the extension arm 132. For instance, as shown in FIG. 1C, the extension arm 132 has pulleys 124 which guide resistance to the user by guiding a cable 120, through which resistance is provided, to the user. As shown, the resistance is presented from a distal end of the extension arm 132. It is contemplated that resistance may be presented from various positions along the extension arm 132 in one or more embodiments.

A user may stand adjacent an extension arm 132 to perform exercises. As will be described further below, in one or more embodiments, it is preferable for the user to stand such that force vector of the resistance is substantially perpendicular to the extension arm 132 when the user's lower arm is substantially parallel to the extension arm 132. The elongated shape of the extension arm 132 allows this to be achieved in one or more embodiments. Also, the extension arm 132 allows the user to stand a distance away from the resistance device 108 thus reducing the risk of the user getting caught on or in the resistance device and injuring him or herself Resistance may be provided through a variety of resistance devices. In general, a resistance device will be configured to provide a force which the user must overcome, resist, or both during training. As shown in FIGS. 1A and 1B, the resistance device 108 may comprise a weight stack 112 in one or more embodiments. Individual weights of the weight stack 112 may be guided by one or more guides 116 as the weight stack or a portion thereof moves.

The resistance device 108 shown provides a fixed resistance in that the amount of resistance (e.g., weight) does not change as the resistance device is used. It is contemplated that the resistance device 108 may also or alternatively provide a variable resistance. For example, springs, elastic bands, or the like may be used to provide variable resistance or instead of the weight stack. Generally, a variable resistance is one that may increase or decrease as it is moved or stretched. For example, as a spring is stretched, the amount of resistance it provides may increase. In contrast, a fixed resistance, such as a weight, remains constant as it is moved.

A user's strength may vary along a strength curve. For example, the strength of a muscle may increase as it contracts. In addition, the body's skeletal structure contains many fulcrum and lever structures (e.g., arms, legs, and their joints) that can make a resistance more or less easy to move depending on the position of these structures. In contrast to a fixed resistance, a variable resistance, in one or more embodiments, may increase with the body's strength curve.

Resistance provided by the resistance device 108 may be presented or transferred to the user in various ways. In some embodiments, a user may directly engage the resistance of a resistance device. For example, a user may grasp or otherwise engage a spring or the like that is attached to a portion of the extension arm. In other embodiments, the user may indirectly engage the resistance. For example, in one or more embodiments, a cable 120 may be attached to a portion of the resistance device 108 to transfer the resistance provided by the resistance device to the user. The cable 120 may be guided by one or more pulleys 124 to the user as will now be described.

As can be seen in FIGS. 1A and 1B, a first end of the cable 120 may be attached to the resistance device 108 while a second end of the cable is presented to a user. To illustrate, the cable 120 illustrated has been attached to the weight stack 112. In this manner, the cable 120 transfers resistance from the weight stack 112 to the user. The cable may 120 extend from the resistance device 108 to the extension arm 132 where it may be presented to a user for engagement or use. As can be seen, a handle 148 or the like may be at a second end of the cable 120 to allow a user to easily engage the cable.

One or more pulleys 124 may be used to guide the cable 120 from the resistance device 108. For example, as shown in FIGS. 1A-1E, the cable 120 may be guided upward from the resistance device 108 to a pulley 124 at the top of the frame 140. The cable 120 may then continue downward to one or more pulleys 124 associated with the extension arm 132. As shown, the pulleys 124 may guide the cable 120 to an end of the extension arm 132 where the cable may be engaged by the user, such as through a handle 148 or the like. It is noted that is an example of how resistance may be guided from a resistance device to a user. It will be understood that the resistance may take a variety of paths between the resistance device 108 and the user.

The pulleys 124 may be attached to the frame 140 or other portion of the shoulder flexion apparatus by one or more mounts. It is contemplated that some mounts may be configured to support two or more pulleys. In one or more embodiments, a pulley 124 may be rotatably mounted to allow the entire pulley (not just the wheel portion of the pulley) to rotate or move. This is beneficial in that it allows the pulleys 124 to guide the cable 120 to the user even when the sections 152, 156 of the shoulder flexion apparatus have been moved relative to one another.

Figure 1E:
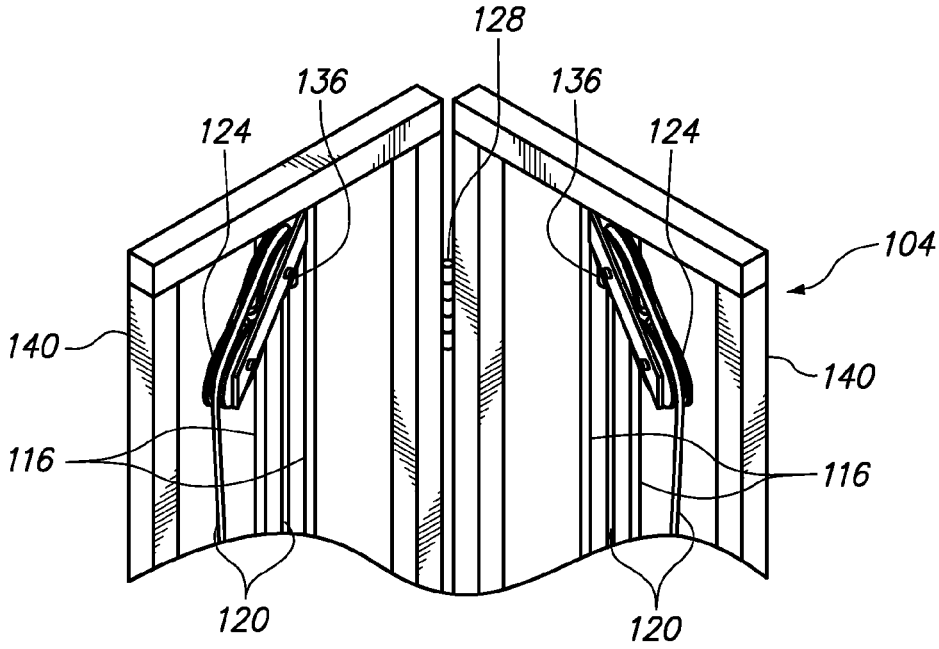
FIG. 1E is a front perspective view of an upper section of an exemplary shoulder flexion apparatus.

Rotation of a pulley 124 may be accomplished through a variety of structures. For example, as shown in FIGS. 1C and 1E one or more pulleys 124 may be mounted to a pivoting mount 136 in one or more embodiments. The pivoting mount 136 allows the pulley 124 to be rotated to various angles from right to left and back. It is contemplated pivoting mount 136 may be configured to allow rotation of 360 degrees in some embodiments. In other embodiments, the pivoting mount 136 may have its range of motion limited. For example, a stop may be provided in some embodiments to prevent a pulley 124 from rotating beyond a particular extent. Though shown as allow a vertically oriented pulleys 124 to rotate, it is noted that a pivoting mount 136 may be used with various pulleys of the shoulder flexion apparatus, regardless of their position or orientation. It is noted that, one or more of the pulleys 124 may be non-rotatably mounted such as by a fixed mount, in one or more embodiments.

An important advantage of pulley rotation is that it allows the shoulder flexion apparatus to be rapidly and easily configured for different types of training For example, the shoulder flexion apparatus may allow a variety of anterior deltoid muscle exercises involving various arm motions. This is beneficial in that the varying arm motions may be used to target a different portion of the deltoid muscles. In one or more embodiments, as will be described below, the user may rapidly switch between lateral and frontal arm movements on the shoulder flexion apparatus, or any angle therebetween. This helps ensure a complete and highly effective workout for the user's anterior deltoid muscles which leads to improved and faster results.

As will become apparent from the disclosure herein, the shoulder flexion apparatus provides switching that is so rapid and convenient that it may be performed between repetitions of a shoulder flexion exercise without delaying the next repetition of the exercise. In fact, a user may alternate between exercise of a first type and exercise of a second type on a per repetition basis, if desired. This speed and versatility is highly advantageous, especially in comparison to traditional devices.

Figure 2A:
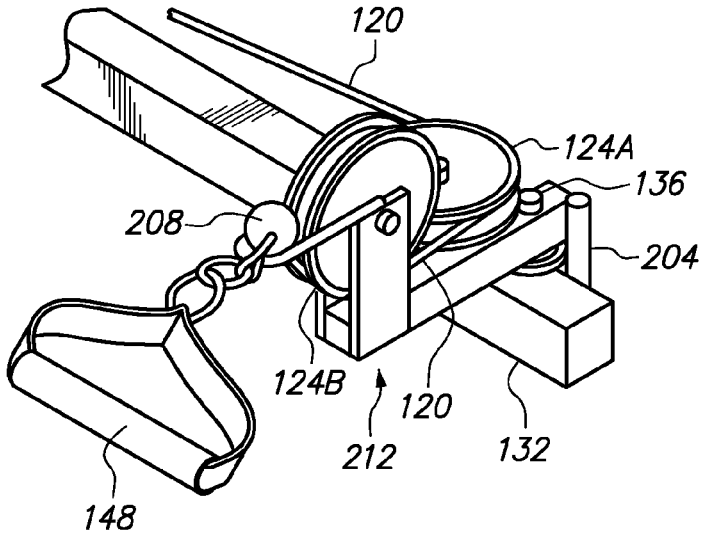
FIG. 2A is a perspective view of an exemplary guide assembly.
Figure 2C:
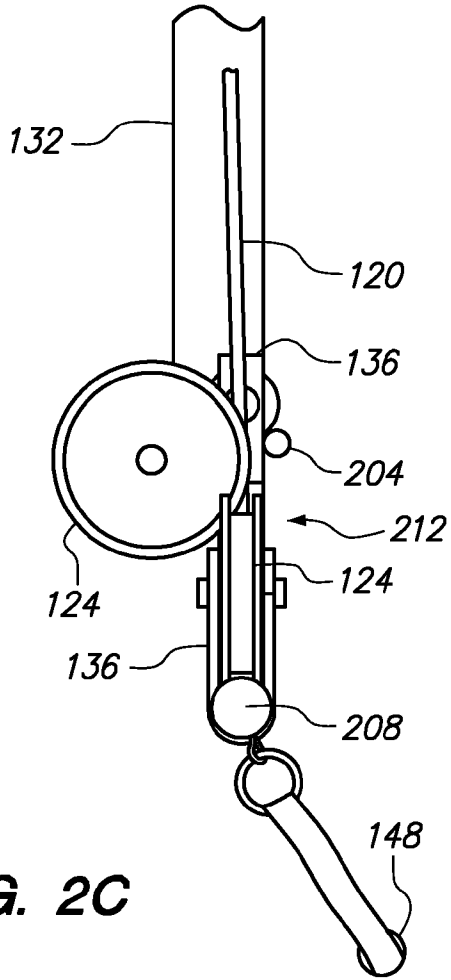
FIG. 2C is a perspective view of an exemplary guide assembly in a second position.
Figure 2B:
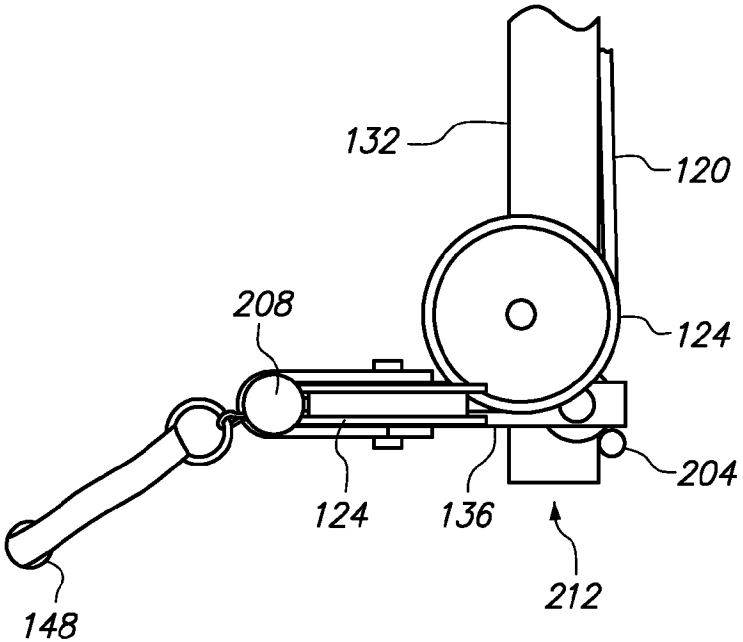
FIG. 2B is a perspective view of an exemplary guide assembly in a first position.

Rapid switching between exercises by pulley rotation will now be described with regard to FIGS. 2A-2C. FIG. 2A is a perspective view of a guide assembly 212 at a distal end of an extension arm 132. In one or more embodiments, the guide assembly 212 may comprise one or more pulleys mounted to a pivoting mount 136. As can be seen by FIGS. 2B and 2C, the guide assembly 212 allows the pulleys 124 to rotate from a first position to a second position. In this manner, different exercises may be performed because the cable 120 and thus the resistance may be presented to the user from different positions. Further details regarding the different exercises will be provided below.

The pulleys 124 of the guide assembly 136 (or elsewhere on the shoulder flexion apparatus) may be ganged together in one or more embodiments. For example, two pulleys have been mounted to the same pivoting mount 136 in FIG. 2A. Of course fewer or additional pulleys may be mounted to a pivoting mount 136 in some embodiments. It is noted that the pivoting mount 136 may comprise one or more mounting structures, such as the rectangular supports shown, to support one or more pulleys.

The pulleys may be mounted in various orientations. For example, as shown, a first pulley 124A may be in a substantially horizontal orientation while a second pulley 124B may be in a substantially vertical orientation. The pulleys may be closely coupled or in close proximity. This coupling or positioning the pulleys 124A,124B helps ensure that the cable 120 remains properly engaged to the pulleys even when the pulleys are rotated or moved.

To illustrate, referring now to FIG. 2A, the horizontally oriented pulley 124A holds the cable's vertical position while the vertically oriented pulley 124B holds the cable's horizontal position. In this manner, the cable 120 remains engaged to the pulleys 124A,124B (e.g., in the grooves of the pulleys) even when the pulleys are rotated or moved. This is also illustrated by FIGS. 2B and 2C. As can be seen, the ganging or coupling of the pulleys 124A,124B hold the cable 120 in position even when the pulleys move or rotate via the pivoting mount 136 from a first position to a second position, and vice versa. The movement of the pulleys 124A,124B causes the second end of the cable 120 to be repositioned. Thus, the force vector presented to the user changes as well.

As stated above, a pivoting mount 136 may allow varying amounts of rotation include a full 360 degree rotation. In some embodiments, rotation may be limited to a particular extent. This is beneficial in that it allows the guide assembly 212 to stop a particular locations associated with particular types of exercises. Rotation may be limited in a variety of ways, as described above. As shown in FIGS. 2A-2C, a stop 204 prevents the guide assembly 212 from rotating beyond a particular extent by physically stopping the pulley from further rotation.

In FIG. 2B, the guide assembly 212 has been rotated such that a first side of the pivoting mount 136 contacts the stop 204, preventing further movement. In FIG. 2C, the guide assembly 212 has been rotated in another direction such that a second side of the pivoting mount 136 contacts the stop, preventing further movement in this direction. As can be seen, a single stop 204 limits rotational movement of the guide assembly 212 in two directions. It is noted that additional stops 204 may be included in one or more embodiments to provide different limitations on rotation of the guide assembly 212. It is also noted that the stop 204 may be configured in various ways. In fact, a variety of structures of devices that can prevent rotation of the guide assembly 212 may be utilized. For example, a stop 204 may comprise one or more clips, clamps, pins, screws, magnets, or other removable fasteners.

In the embodiments shown in FIGS. 2A-2C, both pulleys 124A,124B have been attached to a pivoting mount 136. This is beneficial in that it allows the pulleys 124A,124B to maintain their relative position even though the guide assembly 212 is rotated. This ensures that the cable 120 is securely held by the pulleys 124A,124B. In some embodiments however, only one pulley may rotate to allow switching between exercises.

It is contemplated that pulleys need not be utilized in all embodiments. For example, various cable guides may be utilized at the extension arm 136 (or elsewhere) to guide the cable 120 to the user. Pulleys and similar devices are advantageous in that they do not cause the cable 120 to rub against a surface (altering the resistance provided by the resistance device and/or damaging the cable over time) but rather provide a near frictionless guide for the cable. Thus, the coupling of the pulleys 124A,124B described herein is highly beneficial in that it securely guides the cable 120 while maintaining the advantages of utilizing pulleys. The coupling is also beneficial in that it securely guides the cable 120 even when the guide assembly 212 is moved or rotated rapidly, such as during use of the shoulder flexion apparatus.

As stated, one or more sections 152,156 of the shoulder flexion apparatus may be moved relative to other sections of the apparatus. In general, the mobility of the sections 152,156 is used to accommodate users of various sizes. For instance, by positioning the first section 152 and second section 156 farther apart, users with wider shoulders may be better accommodated while positioning the sections closer together better accommodates users with narrower shoulders. This is illustrated by the overhead views of FIGS. 3A and 3B. In FIG.

Figure 3A:
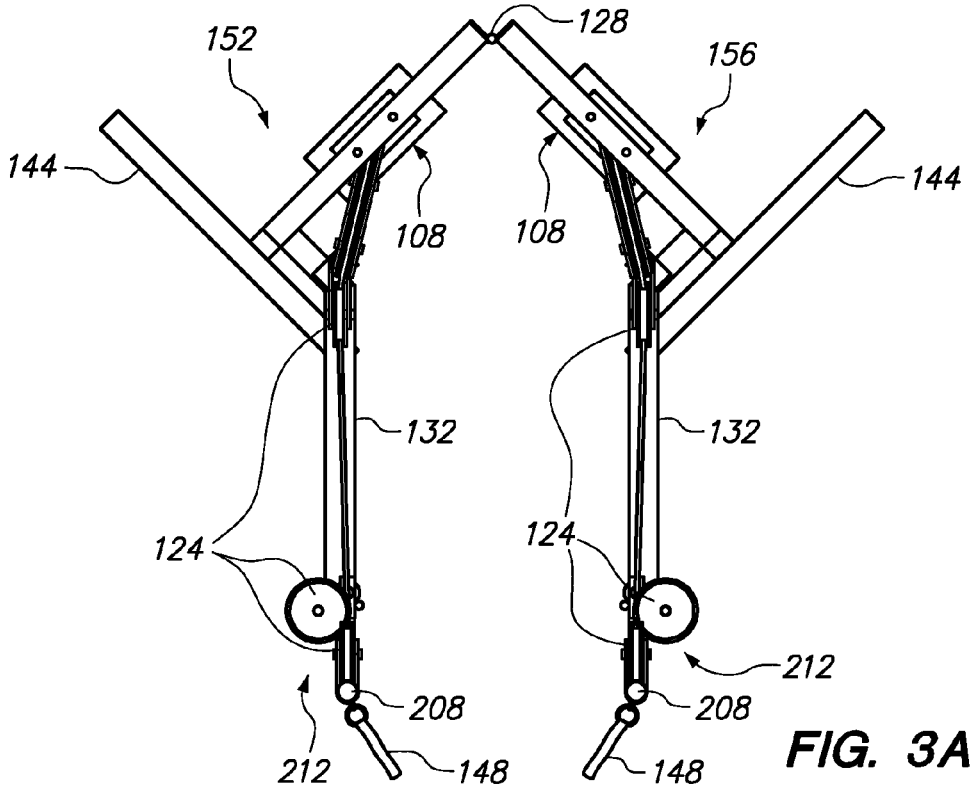
FIG. 3A is a top view of an exemplary shoulder flexion apparatus.
Figure 3B:
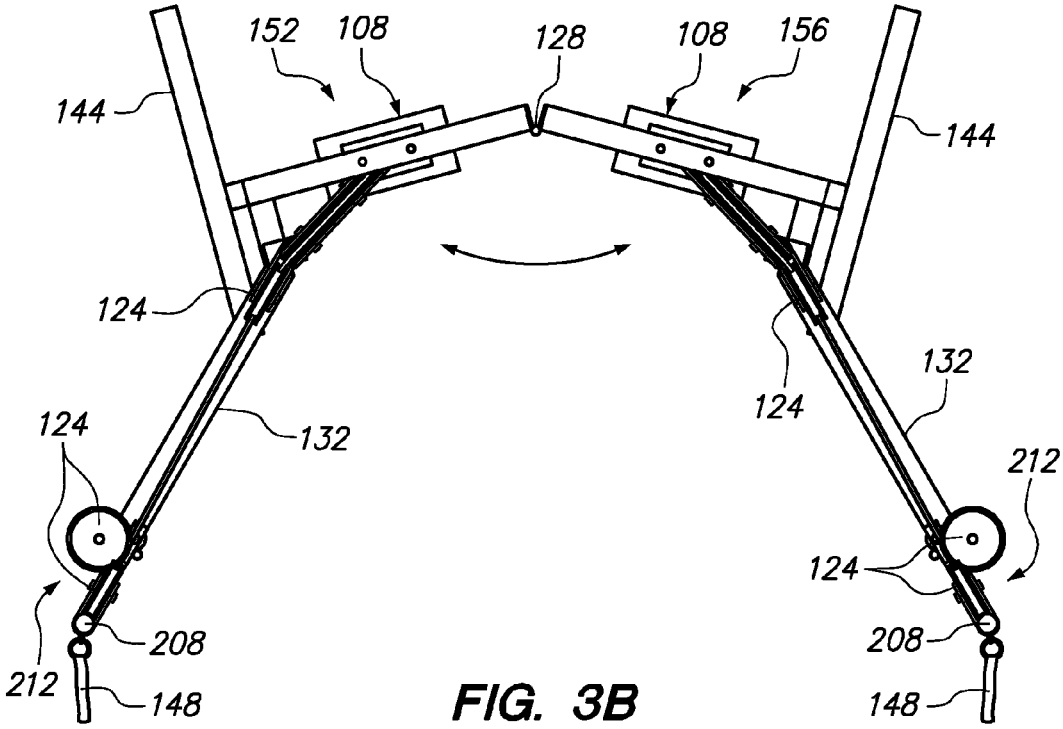
FIG. 3B is a top view of an exemplary shoulder flexion apparatus in an example opened configuration.

3A, the sections 152,156 have been positioned to accommodate a first user, while in FIG. 3B, the sections have been positioned to accommodate a second user. As can be seen, in FIG. 3B, the sections 152,156 have been moved apart such as to allow a larger user to utilize the shoulder flexion apparatus.

Moving the sections 152,156 repositions the extension arms 132 in one or more embodiments. This, in turn, causes the pulleys 124 of the extension arms 132 to be repositioned. Because the pulleys 124 guide the resistance transfer cable to the user, the position of the pulleys generally defines the force vector of the resistance presented to the user. Thus, moving the sections 152,156 may be used to ensure that a resistance with the desired force vector(s) is presented to a user, regardless of the size or shape of the user. As indicated above, further details regarding the force vector(s) generated by the shoulder flexion apparatus will be provided below.

It is noted that the mobility of the sections 152,156 is also useful to reduce the amount of space occupied by the shoulder flexion apparatus, such as when the apparatus is not in use. For example, the sections 152,156 could be positioned in close proximity for storage.

In one or more embodiments, the sections 152,156 may be movable relative to one another by attaching them with one or more movable junctions. For example, the frames 140 of the shoulder flexion apparatus may be joined by one or more hinges 128, pivots, joints, or the like which allow the frames to rotate or pivot relative to one another. This can be seen in the front view of FIG. 1A and the back view of FIG. 1B, among other illustrations provided herewith. In this manner, the width of the shoulder flexion apparatus may be increased or decreased, such as shown in FIGS. 3A and 3B.

It is contemplated that mobility for the sections 152,156 may be accomplished in different ways. For example, the sections 152,156 may be separate structures (i.e., structures which are not attached/connected to one another) that may be moved relative to one another. In unconnected embodiments, the sections 152,156 may be mounted to a movable structure or device, such as one or more wheels or tracks, to allow the sections to be positioned as desired. It is noted that wheels, tracks, or the like may be attached to the sections 152,156 in some connected embodiments as well to make it easier to move the sections. In some connected embodiments, the sections 152,156 may both be attached to a third structure such as a post or other supporting structure by one or more hinges 128, pivots, joints, or the like. In this manner, the sections 152,156 may move relative to one another while being supported by the post or other support.

It is contemplated that the sections 152,156 may be locked or otherwise secured in position once their relative position is established as desired. In the embodiment shown in FIG. 1A for example, friction between the base portion of the sections 152,156 and the floor or ground may be used to hold the sections in position. This friction may be overcome (in various ways) when a user wants to reposition the sections 152, 156. For example, purposeful application of force to move a section may be used to reposition the section as desired. However, the friction holds the sections 152,156 in place when the user is training on the shoulder flexion apparatus.

In embodiments having wheels, casters, tracks, or the like, it is contemplated that one or more sections 152,156 may be moved on or via these devices. In one or more embodiments, these devices may have locking or securing mechanisms to hold a section in a desired position. For example, the wheels or casters may be locking wheels or locking casters which may move freely when unlocked and hold their position when locked. Likewise, a track may comprise one or more securing mechanisms. For example, the track may allow one or more fasteners or apply a clamping force to secure the position of a section.

It is noted that in some embodiments, only a portion of a section 152,156 may be movable. For example, it is contemplated that only the extension arms 132 may be movable to accommodate users of various sizes in some embodiments. The extension arms 132 may be attached to their corresponding frames 140 by hinges, pivots, or the like to achieve this mobility. Once positioned as desired the extension arms 132 may be secured by various structures. For example, the extension arms 132 may be held in position by one or more fasteners, clamps, and the like.

Exemplary types of exercises that may be performed on the shoulder flexion apparatus will now be described. As will become apparent from the discussion below, the exercises will generally target the user's shoulder muscles and body structures, namely the anterior deltoid area. This tones and strengthens the muscles and body structures of the shoulders including the anterior deltoid muscles and associated body structures.

The shoulder flexion apparatus is highly advantageous in training the shoulder muscles and anterior deltoid muscles because of the type of resistance it provides. As discussed above, the shoulder flexion apparatus provides resistance having a downward force vector. The user may overcome this resistance with an upward motion of his or her arm(s). This motion is powered, at least in part, by the user's anterior shoulder and chest muscles, which are in the same region as the anterior deltoid muscles.

As also discussed above, the shoulder flexion apparatus allows rapid switching between different exercises. In one or more embodiments, the force vector may be rapidly changed from one configuration to another as desired by the user to provide these different exercises. It is contemplated that each exercise may provide a different effect, for example by focusing on or targeting different muscles and body structures associated with the shoulder region, namely the anterior shoulder region, of the user. This may be accomplished by requiring or allowing the user to utilize different body motions (e.g., different arm and/or upper body motions) to move the resistance provided by the shoulder flexion apparatus. For example, the guide assembly of the shoulder flexion apparatus may move from a first position to a second position with the second position allowing or requiring different user motions to move the apparatus' resistance.

Figure 4A:
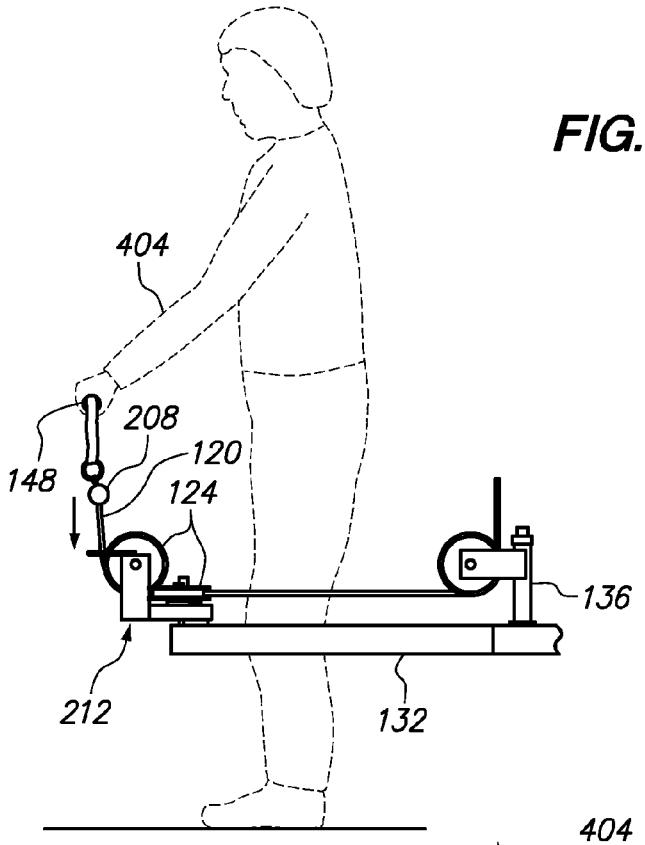
FIGS. 4A-4B illustrate exemplary exercises of a first type performed on an example shoulder flexion apparatus.
Figure 4B:
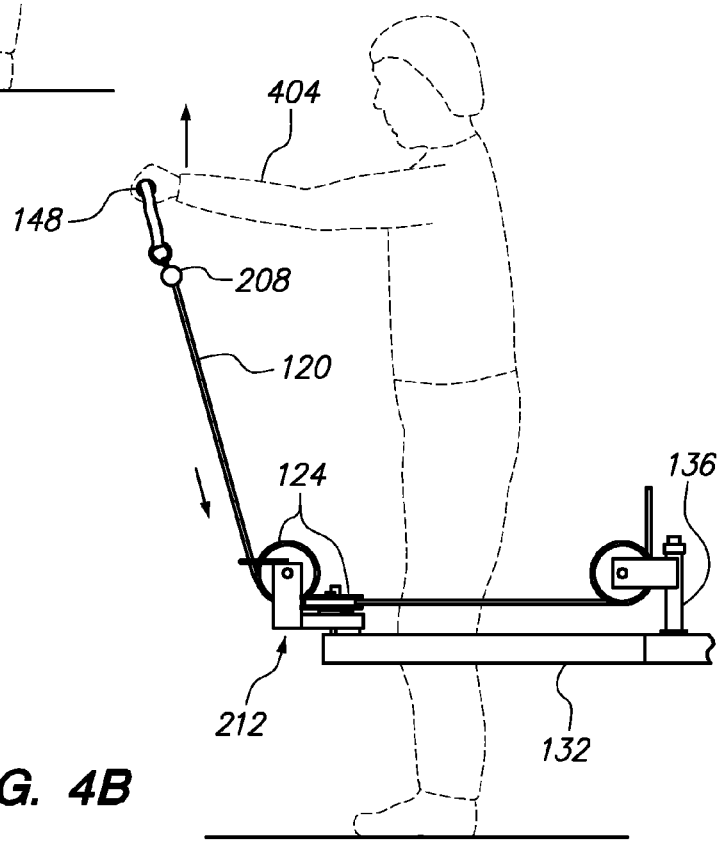

FIGS. 4A and 4B illustrate an exemplary exercise of a first type which may be performed on the shoulder flexion apparatus. As will be described below, the exercises of the illustrated type involve frontal motions of the user's arms. Though described in the following as training both sides of a user's body, it will be understood that the user may train one side of his or her body at a time, such as by only engaging one section or side of the shoulder flexion apparatus at a time.

In FIG. 4A, a side view shows that the user has engaged the resistance of the shoulder flexion apparatus by engaging the user end of the cables 120. In the embodiment of FIG. 4A, the user has engaged the cables 120 by grasping a handle 148 of the cables. The cables 120 transfer the resistance, which has a downward oriented force vector as indicated by the arrow adjacent the cables, to the user.

To begin a repetition of shoulder exercise, the user may hold the cables 120 with his or her palms facing downward, such as shown in FIG. 4A. It will be understood that though the user is holding the cables 120 at a particular position, the user may hold the cable at various positions. In general, it is beneficial to hold the cables 120 at a lowered position to allow the cables to be raised as exercise continues.

The user may then move his or her arms 404 upward to continue the repetition. For example, as shown in FIG. 4B, the user has moved his or her arms 404 upward from the initial position in FIG. 4A. In this manner, the user overcomes the resistance causing the handle 148 and cable 120 to lift. The force used to overcome the resistance is at least in part provided by the shoulder muscles, namely the anterior deltoid muscles. Thus, these muscles are toned and strengthened. Though shown at a particular position in FIG. 4B, it is contemplated that the user may raise his or her arms 404 to various positions, as desired. In general, the more a user lifts his or her arms, the more beneficial training will be.

FIGS. 4A and 4B show arm motions at the front of the user's body. More specifically, the user may position the arms in front of him or herself and raise the arms to exercise. In this manner, the exercise may be considered a frontal exercise. It is contemplated that the user may raise his or her arms in various ways. For example, the user may hold the cables 120 with his or her palms facing upward and raise his or her arms 404. In one embodiment, the user may raise his or her arms 404 by bending at the elbows while holding the cable in this position. Because these motions also utilize the shoulder muscles, the users shoulder muscles including the anterior deltoid muscles undergo training as the arms are raised.

Raising the arms in different ways may be desirable to some users. In one embodiment for example, raising just the forearms, such as by bending at the elbows, may cause the resistance to be more focused on a particular shoulder region, thus enhancing training Raising the entire arm may cause the user to experience additional resistance, also to enhance training.

Once at a raised position, such as that of FIG. 4B, the user may lower his or her arms. For example, the user may lower his or her arms 404 back to the initial position (or other lowered position), such as shown in FIG. 4A. To illustrate, the user may lower the arms 404 by rotating the arms at the shoulders. It is noted that the arms may be lowered in other ways as well. For example, the arms 404 may be lowered by bending at the elbows. Similar to raising the arms, utilizing different motions to lower the arms may better focus the resistance one particular areas and/or increase the amount of resistance experienced by the user, thus enhancing training During this motion, the user continues to experience the resistance, shown by the arrow adjacent the cable 120. Thus, toning and strengthening continues as the arms are lowered because the user must resist the downward force vector of the resistance as he or she lowers his or her arms 404. The user may repeat the raising and lowering of the arms 404 one or more times. It is noted that in some embodiments, exercise may begin at the raised position, such as shown in FIG. 4B, and continue to the lowered position, such as shown in FIG. 4A.

Figure 5A:
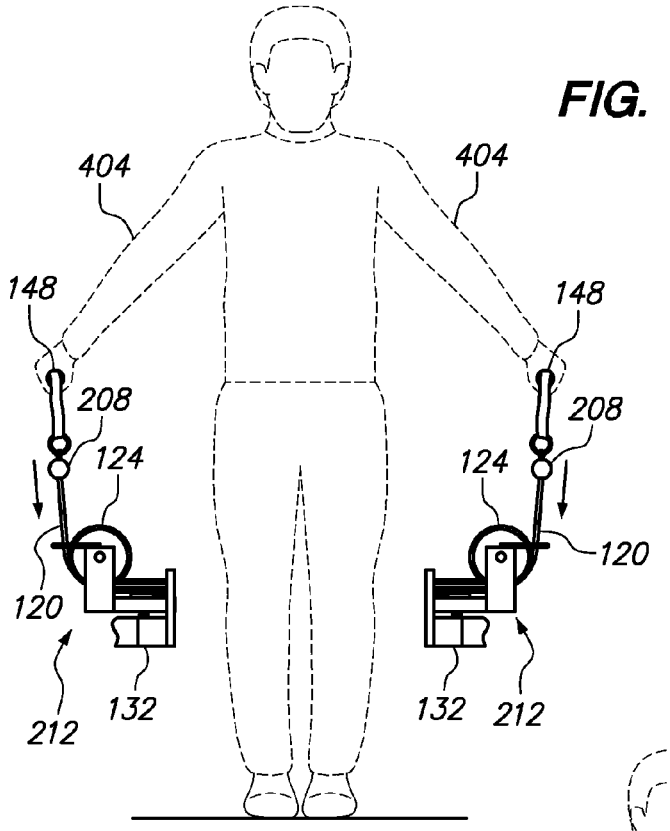
FIGS. 5A-5B illustrate exemplary exercises of a second type performed on an example shoulder flexion apparatus.
Figure 5B:
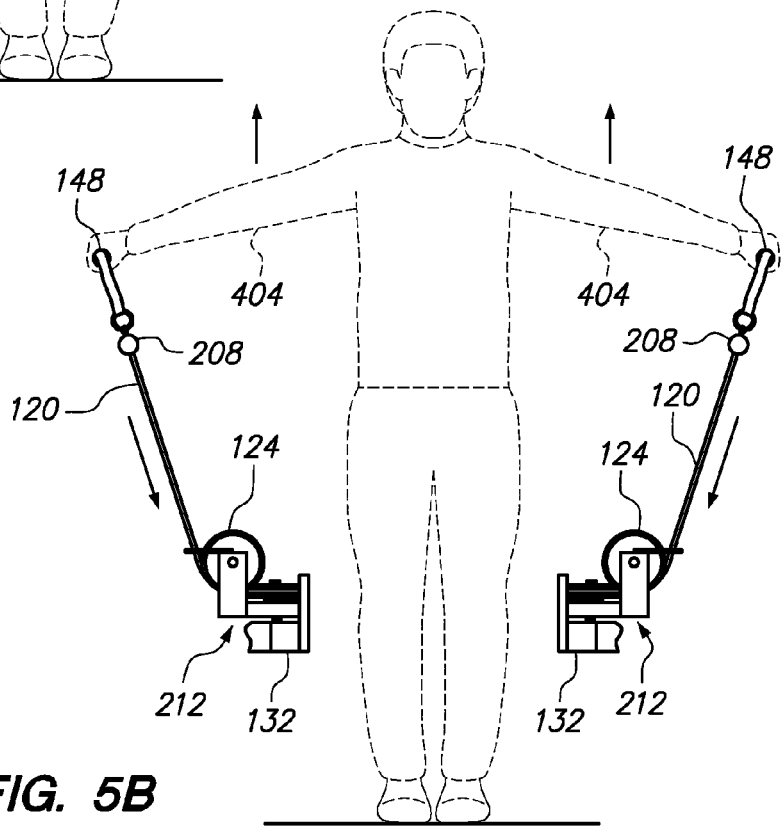

FIGS. 5A and 5B illustrate an exemplary exercise of a second type that may be performed on the shoulder flexion apparatus. As will be described below, the exercises of the illustrated type involve lateral motions of the user's arms. Though described in the following as training both sides of a user's body, it will be understood that the user may train one side of his or her body at a time, such as by only engaging one section or side of the shoulder flexion apparatus at a time.

In FIG. 5A, the user has engaged the resistance. Namely, the user has grasped the handles 148 of the cables 120 with his or her palms facing down, and is experiencing the resistance provided through the cables. As illustrated by the arrows adjacent the cables 120, the resistance has a downward oriented force vector. In contrast to the above exercises, the user's arms are positioned to the user's sides (i.e., laterally). To illustrate, in FIG. 5A, the user is holding the cables 120 at the user's sides rather than in front of (or at another position) the user.

In this initial position, the user may hold the cables 120 such that his or her arms 404 are at a lowered position, such as shown in FIG. 5A. It is noted that the user may hold the cables 120 at various other locations in the initial position. In general, it is beneficial to hold the cables 120 at a lowered position to begin exercise. This allows the cables 120 to be raised as exercise continues.

Once in the initial or lowered position, the user may raise his or her arms. To illustrate, in FIG. 5B the user has raised his or her arms 404 to a raised position. This may be accomplished by raising the arms 404 at the shoulders while holding the cables 120 with the palms facing downward, such as illustrated. In making these arm motions, the user overcomes the resistance provided via the cables 120. Like the above, these arm motions are, at least in part, powered by the shoulder muscles, namely the anterior deltoid muscles. In this manner, the user's shoulder muscles are toned and strengthened.

Like the frontal exercises above, the user may raise his or her arms in a variety of ways when moving the arms laterally. As stated, in FIG. 5B, the user has raised the arms by bending at the shoulders. In other embodiments, the user may raise the arms by bending at the elbows. For example, the user may hold the cables 120 with his or her palms facing upward, and then bend at the elbows to raise the cables. As stated, raising the arms in different ways may be desirable to some users in that the resistance may be more focused on the shoulder region and/or a higher amount of resistance may be experienced.

Once in the raised position, such as shown in FIG. 5B, the user may continue exercise by lowering his or her arms. For example, the user may lower his or her arms back to the initial or lowered positions, such as illustrated in FIG. 5A. Like the frontal exercises, the user must resist the resistance as the arms 404 are lowered. In this manner, the user continues to tone and strengthen the shoulder muscles as the arms 404 are lowered.

In FIG. 5A, the arms have been lowered by rotating the arms 404 at the shoulders. It will be understood that the arms 404 may be lowered in various ways. For example, the arms 404 may be lowered by bending at the elbows such as when the cables 120 are being held with the user's palms facing upward.

The switch between frontal exercises and lateral exercises may be rapidly achieved at various points during an exercise on the shoulder flexion apparatus. Referring back to FIGS. 2B and 2C, the guide assembly 212 may be in a first position, such as in FIG. 2C, to support a frontal exercises and be moved to a second position, such as in FIG. 2B, to support lateral exercises. The position of the guide assembly 212 may be controlled by moving the associated cable 120.

Because the cable 120 is held by one or more pulleys 124 of the guide assembly 212, the guide assembly may be moved or rotated by moving the cable. For example, grasping the handle 148 and moving the user's arms to a frontal position may cause the guide assembly 212 to rotate or move to a first position, such as that shown in FIG. 2C. Likewise, moving the user's arms to a lateral position (at the user's sides) while grasping the handle may cause the guide assembly 212 to rotate or move to a second position, such as shown in FIG. 2B.

It can thus be seen, that switching between exercises may occur as rapidly as the user can move his or her arms from one position to another. It can also be seen, that switching to different exercises can be easily accomplished with a simple motion of the user's arms while the user is engaged to the cable 120.

Referring now back to FIGS. 4A and 4B and FIGS. 5A and 5B, it can be further seen that the guide assembly 212 may be used to switch exercises at various points during an exercise. For example, a user may perform one or more repetitions of frontal exercises as shown in FIGS. 4A and 4B. To switch to lateral exercises, the user may move or swing his or her arms to his or her sides while the arms are in a raised position, lowered position, or even while the arms are transitioning from a raised position to a lowered position (or vice versa). To switch to frontal exercises, the user may move his or her arms to the front of his or her body while the arms are in a raised position, lowered position, or even while the arms are transitioning from a raised position to a lowered position (or vice versa).

In this manner, the user may perform one or more frontal exercises and then rapidly switch to lateral exercises, or vice versa. In fact, the user may alternate frontal and lateral exercises such as by performing one repetition of each before switching exercises. Moreover, the user may even switch during a repetition. For example, the user may raise the arms while in a frontal position and lower the arms while in a lateral position, or vice versa. The user may also blend the frontal and lateral exercises. For example, the user may switch between the frontal and lateral exercises as the arms are being raised or lowered. In fact, the guide assembly 212 is so versatile that it allows switching between exercises multiple times during a single repetition of frontal, lateral, or combined exercises.

The switching of exercises/positions is highly beneficial to complete training of the shoulder muscles. For example, training according with a first exercise may target resistance to a first set of shoulder muscles, while training according to a second exercise may target resistance to a second set of shoulder muscles. The first and second set of muscles may contain entirely different shoulder muscles, but will typically share at least one shoulder muscle. Exercises involving a transition between a first exercise and second exercise would thus spread training to the first and second sets of shoulder muscles. It is contemplated that a first exercise and a second exercise may target all the muscles of the anterior deltoid region, alone or in combination. In this manner, the anterior deltoid muscles are comprehensively toned and strengthened along with their associated body structures.

The different types of exercises may focus on various regions of the shoulder, in addition to or instead of the anterior deltoid area in one or more embodiments. Thus, a first exercise and second exercise may individually or in combination train all the muscles of the shoulder or a variety of subsections thereof. Where a first exercise is not capable of targeting certain muscles a second exercise may be used to target these muscles. Because the shoulder flexion apparatus allows rapid switching between the first and second exercise, complete training of the desired muscles can be achieved if not by a first exercise, then by a combination of two or more exercises.

It is noted that the guide assembly 212 may be configured for multiple distinct positions. Thus, the shoulder flexion apparatus is not limited to a first and second exercise. For example, the guide assembly 212 may have three or more positions thus allowing three or more different exercises to be performed on the shoulder flexion apparatus. To illustrate, the guide assembly 212 may have a first position and second position, such as shown in FIGS. 2B and 2C. The guide assembly 212 may then also have a third position (as well as additional positions) that may be between the first and second position. The third position may correspond to a set of shoulder muscles different than that of the first or second position. As described above with regard to switching between two exercises, switching to the third exercise/position may likewise be quickly and easily accomplished on the shoulder flexion apparatus. In this manner, comprehensive training may be achieved easily and conveniently on the shoulder flexion apparatus.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A shoulder flexion apparatus comprising:

a first guide assembly configured to present a first resistance to a user along at least one first force vector, wherein the first guide assembly is movable to change the at least one first force vector;

a second guide assembly configured to present a second resistance to a user along at least one second force vector, wherein the second guide assembly is movable to change the at least one second force vector;

one or more resistance devices configured to provide the first resistance and the second resistance;

a first support comprising a lower portion and an upper portion, the first guide assembly attached to the lower portion of the first support; and a second support comprising a lower portion and an upper portion, the second guide assembly attached to the lower portion of the second support;

wherein the one or more resistance devices comprise a first weight stack and a second weight stack, the first weight stack supported by the first support, the second weight stack supported by the second support.

* * * * *